455-603 AU 263 EX
3/25/86 XP 4,578,671

United States Patent [19]

Flowers

[11] Patent Number: 4,578,671

[45] Date of Patent: Mar. 25, 1986

[54] REMOTE INDICATING LOW BATTERY VOLTAGE ENUNCIATOR METHOD AND APPARATUS

[75] Inventor: Dale R. Flowers, Raleigh, N.C.

[73] Assignee: International Business Machines Corp., Armonk, N.Y.

[21] Appl. No.: 678,434

[22] Filed: Dec. 5, 1984

[51] Int. Cl.[4] ..... G08B 21/00

[52] U.S. Cl. ..... 340/636; 340/531; 358/192.1; 371/29; 371/66; 455/603

[58] Field of Search ..... 358/192.1; 455/603; 371/29, 66; 340/636, 531, 663; 364/200 MS File, 900 MS File, 200, 900

[56] References Cited

U.S. PATENT DOCUMENTS 4,056,815 11/1977 Anderson ..... 340/539
4,191,948 3/1980 Stockdale ..... 340/539
4,232,308 11/1980 Lee et al. ..... 340/539

FOREIGN PATENT DOCUMENTS 2855809 10/1979 Fed. Rep. of Germany ..... 340/636

*Primary Examiner*—James L. Rowland
*Assistant Examiner*—Daniel Myer
*Attorney, Agent, or Firm*—E. H. Duffield

[57] ABSTRACT

A low battery voltage indicator is for use with remote control keyboards which are not linked by a cable to a power supply. Such keyboards contain their own power and are widely used. Remote keyboards that are infra red linked to personal computers are widely available. Similarly, remote control TV channel selectors utilizing infra red links are extensively used and sold. A majority of these devices utilize a battery to power the transmitter for the infra red communication link from the remote unit to the base unit. This is an improved low voltage indicator circuit and technique that utilizes the infra red link and the key encoding circuits of the keyboard to transmit to the base station a key code indicative of the fact that low battery voltage exists. At the base station, the key code is received and is looked up in a table that identifies the key code as a low battery voltage indication. This causes the base station to flash a low battery voltage warning message on the display screen. This replaces a low battery indicator light or buzzer on the remote keyboard unit which normally can use even more power than the infra red transmitter. It also avoids the use of such local devices as buzzers or lights that would only worsen the low battery voltage condition already present.

5 Claims, 5 Drawing Figures

R1 10K
R2 10K
R3 10K
R4 10K
R5 10K
R6 10K
R7 10K
R8 10K
KEYBOARD
DR0
DR1
DR2
DR3
DR4
DR5
DR6
DR7
SNS0
SNS1
SNS2
SNS3
SNS4
SNS5
SNS6
SNS7
P10
P11
P12
P13
P14
P15
P16
P17
P20
P21
P22
P23
P24
P25
P26
P27
DB0
DB1
DB2
DB3
DB4
DB5
DB6
DB7
X1
X2
RST
T0
T1
INT
ALE
RD
WR
PSEN
SS
EA
PROG
Vdd
Vcc
GND
13
20
-IR ENABLE
21
1

REMOTE INDICATING LOW BATTERY VOLTAGE ENUNCIATOR METHOD AND APPARATUS

FIELD OF THE INVENTION

This invention relates to keyboards and data input devices in general and specifically to remote control keyboards and control devices used with a base system or computer and in which sonic or infra red cableless links for communicating the control and/or key information to the base unit from the remote keyboard or controller are utilized.

BACKGROUND OF THE INVENTION

Prior Art

A good deal of prior art exists in the field of remote control devices and keyboards in which the control information is linked via either an audio or optical path so as to avoid the use of cables, wires and the like. Typical examples are the well known remote control channel selection utilized in many home TV sets. These devices utilized either sonic or ultrasonic codes or, in the alternative, often use infra red transmitters with a receiver at the base station or TV set. The general usage of infra red links for data processing input from keyboards or terminals to a large using system has also been investigated as shown by the IEEE article "Infra Red Communication for In House Applications," by F. R. Gfeller et al, appearing at pages 132–138 reprint number CH1388-8/78/000, copyright 1978, IEEE.

In all of these applications for remotely linked data input or control devices utilized without cables or physical connection, a possibility exists that the remote control device or keyboard will be self-powered, i.e., by a battery or the like. Typical dry cell batteries exhibit a declining voltage versus power-on time characteristic over their life. Eventually, the total battery voltage available will decrease to the point that unstable communication or control exists. At this point, the keyboard or control mechanism will fail and will cause the user to experience inconvenience, especially if no spare batteries are available. A low voltage battery warning indicator is clearly called for. However, a variety of these low battery voltage indicators that are available such as audible or visual indicators and enunciators consume much more power than the infra red transmitter itself. Once the overall battery voltage has dropped to be within the danger zone, the use of such an indicator could greatly worsen the battery's condition at the most critical time.

An additional factor is that dry cell batteries typically exhibit a declining voltage with time regardless of use, but it is only desirable to actually indicate low voltage condition when an operator is present and the device is in use so that corrective action may be taken.

OBJECTS OF THE INVENTION

In view of the foregoing known shortcomings with prior art low voltage warning indicators, it is an object of this invention to provide an improved low battery voltage warning method and apparatus in which the visual display associated with the system being controlled by a remote keyboard or controller is directed to give a visual warning or indication of the condition.

Yet another object of this invention is to provide an improved low battery voltage enunciator method and apparatus in which unused codes that may originate from the remote control unit or keyboard are employed by a low battery voltage indicator circuit for signaling to the base station or controlled element over the infra red, acoustic or ultrasonic link an indication that low battery voltage exists.

SUMMARY

The foregoing and still other unenumerated difficulties with the known prior art are overcome and the objects set forth above fully met by a preferred embodiment of the invention which includes a low battery voltage detection circuit in the remote control keyboard or controller. This circuit takes advantage of the common state of the art for remote keyboards or controllers in which the input buttons or switches are scanned by an onboard microcomputer and scanner arrangement which provides appropriate key codes outputted for actuated switches or key buttons. Such scanners typically have one or more unused codes depending upon the configuration of the keyboard or controller. The present invention utilizes one of the unused codes or inputs to the scanner and microprocessor to alert the onboard microprocessor that a low battery voltage condition has been detected. The processor then outputs a key code or control code that has not previously been assigned to those key buttons or switches on the keyboard. This may be readily transmitted over the infra red or acoustic link using the regular onboard transmission circuitry. The code will be received at the base station or controlled element by an infra red or acoustic receiver. The signals then received are sent to the control processing unit, typically the microprocessor in the base station, for interpretation. Key codes are normally interpreted and displayed through CPU control on the screen of a CRT monitor by directing a CRT controller to generate a specific character based upon the key codes received. When an unassigned key code is detected, the CPU does a table look-up to discover that this particular code is assigned the function of being a low battery voltage indicator. The CPU may then take the appropriate action of directing the CRT controller to exhibit a message on the CRT monitor itself that low battery voltage has been detected. The message or a blinking indicator or any suitable design are available as options and are limited only by the user's imagination. The present invention actually utilizes the encoding and transmission and reception circuitry of the existing remote keyboards controllers, and base stations in an improved fashion to provide a direct indication to the user that the low battery voltage condition exists. At the same time the indicator does not draw undue amounts of power from the already critically low battery supply.

BRIEF DESCRIPTION OF THE DRAWINGS

The invention will be described with reference to a preferred embodiment thereof as further shown in the attached drawings in which.

DETAILED SPECIFICATION

Figure 1:
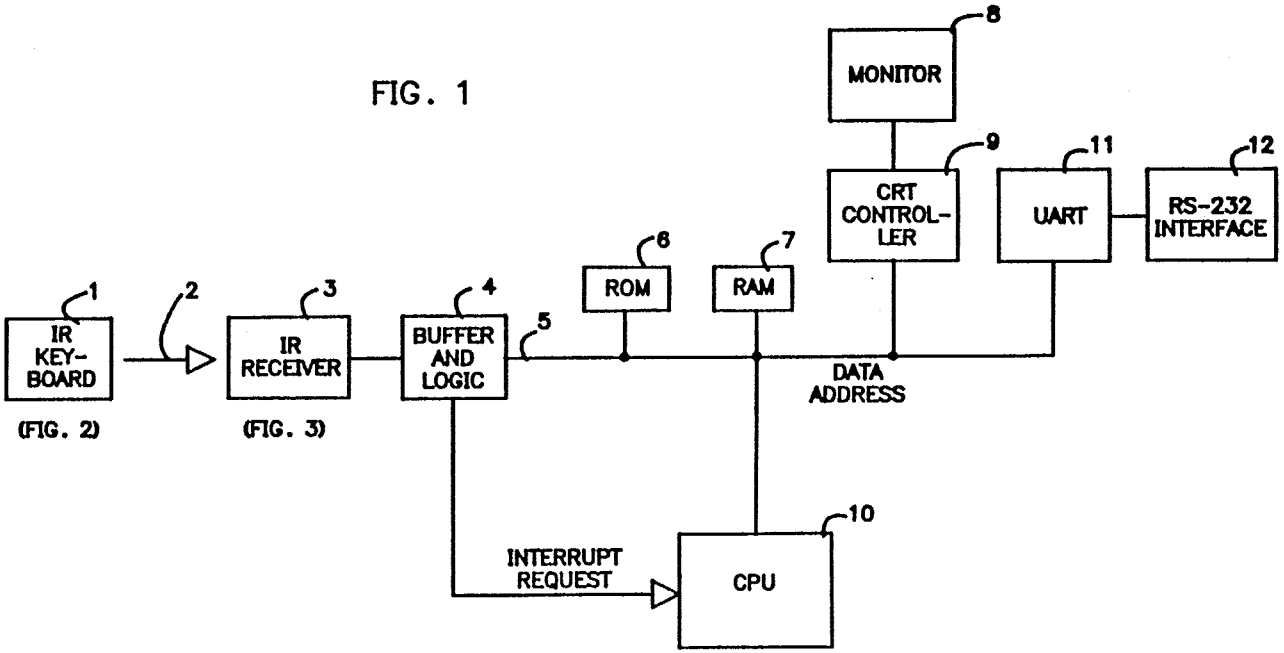
FIG. 1 illustrates an overall block schematic diagram of a typical remote infra red transmitting keyboard or controller and a base station infra red receiver and computer for acting upon commands or key codes presented by the remote unit.

Turning to FIG. 1, a preferred embodiment of the present invention will be described with reference to a typical remote infra red transmitting keyboard and base station having an infra red receiver. Such devices are widely employed in the present state of the art personal computers utilizing remote cableless keyboards. These keyboards utilize an on board microprocessor powered by self-contained dry cells. The infra red keyboard unit 1 communicates over an infra red link shown as 2 to the infra red receiver circuit in the computer base station. Normally, key codes are transmitted in this fashion for reception by the receiver and input into the buffer and station control logic 4. The buffer will group the codes into typically 8-bit words for application to a data and address bus 5. When data or address information is present in the buffer 4 an interrupt request is typically presented to the base station processor 10. This is usually a microprocessor or the like and has associated with it the usual read only memory 6, random access or dynamic memory 7 and various I/O devices such as a universal asynchronous receiver transmitter 11 that may transmit to a digital interface such as a typical EIA RS-232C interface depicted as 12 in FIG. 1.

A CRT controller 9 is attached to the data and address bus 5 and receives commands or control information from the CPU 10 for display on the monitor 8. All of the elements 3 through 12 are general state of the art devices well known in the field and are necessary to understanding the present invention. They are shown here for understanding the distinctions added in the present invention over the usual system. In fact, the infra red keyboard 1 is also a state of the art, commercially available, infra red remote keyboard. These exist not only for home computers but for remote control of television sets and the like. Similarly, ultrasonic control links may be utilized instead of the infra red link 2.

The present invention can utilize either form of link equally well as will be apparent. The low battery voltage indication method and apparatus are embodied in the state of the art elements shown in FIG. 1 by improvements and additions thereto which will now be described in greater detail.

Figures 2, 2A, 2B:
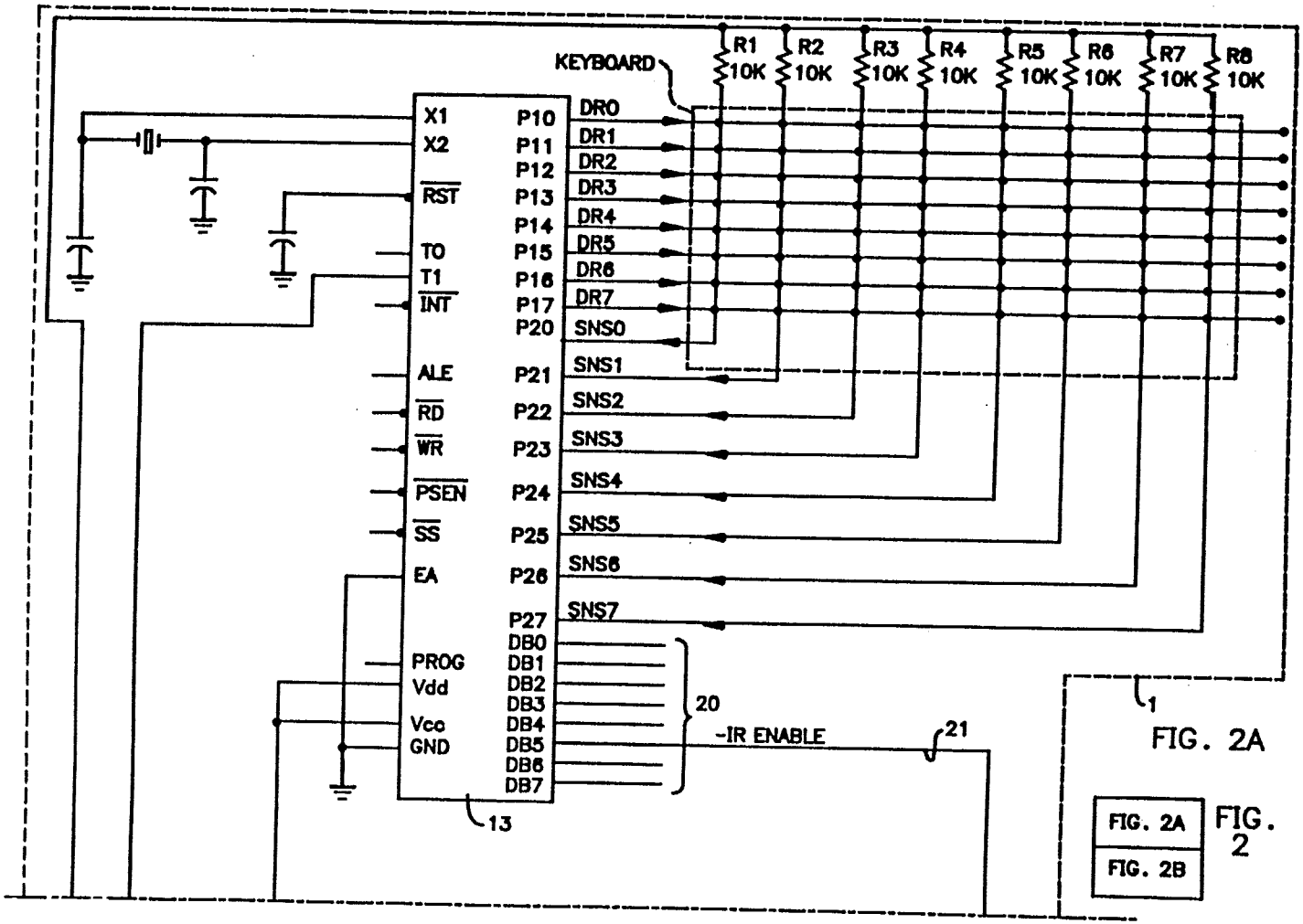
FIGS. 2, 2A and 2B illustrate a typical schematic diagram for a microprocessor based remote keyboard unit utilizing an infra red transmission link.
Figure 2B:
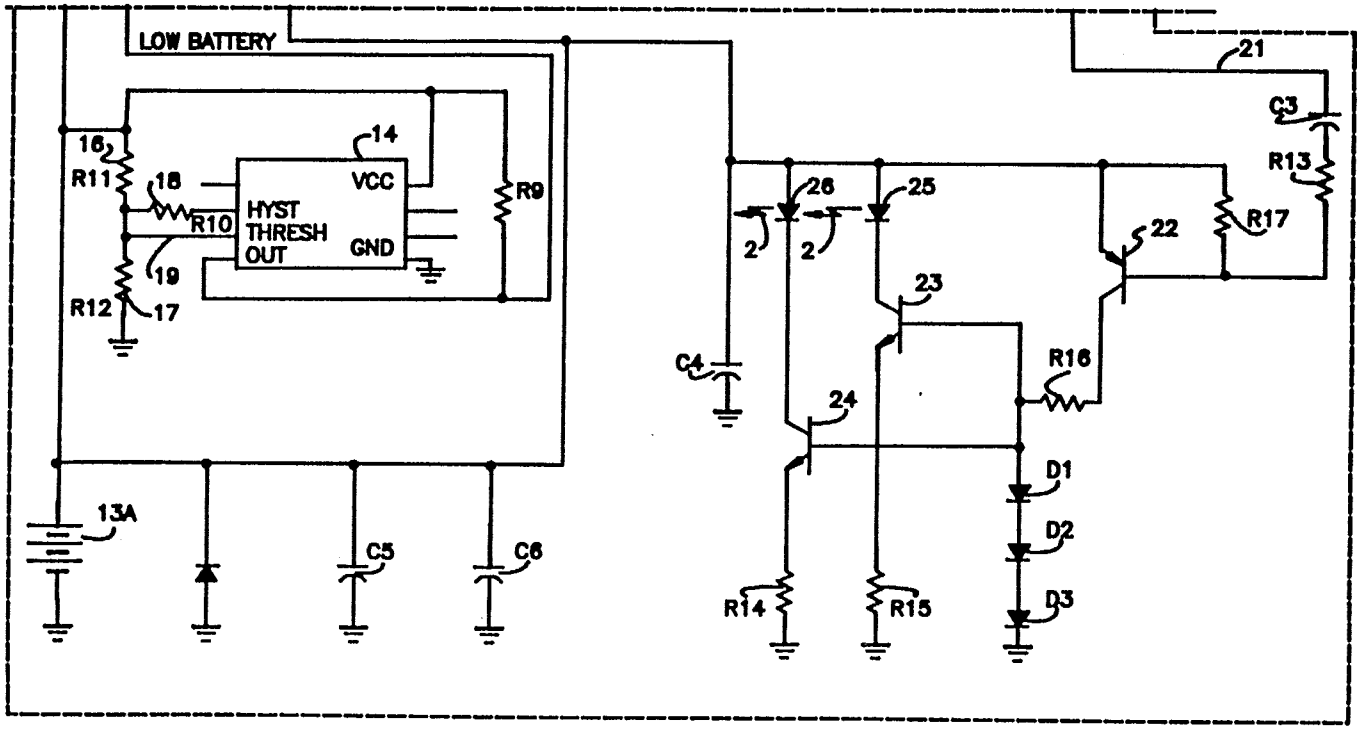

Turning to FIG. 2, an electrical schematic diagram is given for a typical infra red, microprocessor based remote keyboard logic and control system for a keyboard 1 such as shown in FIG. 1. The improved circuitry and method of the present invention have been added in FIG. 2 to existing circuit elements and devices as will be described.

A typical microprocessor based keyboard scanner and encoder such as utilized in the present invention contemplates the existence of a dedicated on board microprocessor 13. Typical examples are the Intel 8048 style of microprocessor driven keyboard scanner and encoder widely sold and utilized in the industry. The microprocessor 13 in FIG. 2 scans the intersections of switches in a keyboard or controller panel at high speed based upon an internal crystal controlled oscillator clock and, in the case of a self-contained power supply keyboard, is powered by a typical 6-volt battery 13A as shown. The details of such a keyboard scanner and processor are not given further since these are commercially available and have been for several years. What is novel in the present invention is the method and apparatus of indicating low battery voltage in conjunction with such a system. Typically, keyboard processor scanners may scan 64, 96 or 128 key or switch locations, but not all keyboards and controllers utilize all of the available codes. Indeed, it is much more usual that not all codes are utilized and that one or more unused key codes may be outputted from the microprocessor 13 when it is directed to do so.

Key codes are outputted from the processor 13 over the output ports 20. Typically, for a remote infra red or acoustic signalling keyboard, only one of the output lines such as output line 21 is serially driven to provide an output code of on/off pulses or pulse levels in accordance with the signalling scheme employed by the infra red link transmitter utilized. Key codes on line 21 are applied to a driving transistor 22 which, in turn, drives the dual output transistors 23 and 24 to illuminate dual light emitting diodes 25 and 26 to drive signals over the optical link 2 as schematically shown in FIG. 2. The photo diodes 25 and 26 are simultaneously pulsed on and off or at various levels of power (not shown in this circuit) at frequencies supplied by the output from the processor 13. This pulsating analog light emission on the channel link 2 is received as shown in FIG. 1 by an infra red receiver 3 at the other end of the link 2.

In the present invention, a precision threshold detection circuit 14 comprising a divider bridge comprising resistors 16 and 17 is utilized to provide an output on line 15 to an unused input or signalling port on the processor 13. This is used to direct the output therefrom over line 21 of a unique code not among those utilized in the keyboard or control panel. It is this code, when received and formed into a byte by the receiver 3 and buffer 4, which alerts the CPU 10. The CPU does its usual table look-up to identify what code has been received. The CPU 10 must be programmed in its RAM 7 or ROM 6 to recognize the specific key code employed as actually representing the low battery voltage condition. Since key codes are normally assigned and written into RAM or ROM for each individual keyboard system, it is no great task to assign an additional unused key code to the function of indicating low battery voltage and causing the CPU 10 to direct such a message to the CRT controller 9 for display on the display monitor 8. The incoming low battery voltage code indication is simply treated like any other incoming key indication or switch indication by the CPU 10 at the receiving base station. However, instead of directing the display of an indicated key character or the like, the display is controlled to show a warning message or signal to the user that a low battery voltage condition exists.

In FIG. 2, the low voltage detector circuit compares a fraction of the battery voltage from battery 13A to a 1.15 volt internally established reference voltage. The resistors 16 and 17 divide the battery voltage by 4.45 so that the battery voltages of 5.1 volts or lower will trigger the detector circuit 14. The 5.1 volt level comes about from the 4.45 division ratio multiplied by the internal 1.15 volt reference level. Other typical levels may be chosen at the user's will. However, the 5.1 volt trigger level is approximately 12 to 15% below the nominal 6-volt battery level and is the usual level at which microcircuitry may become unstable.

The resistor 18 provides hysteresis to prevent the detector circuit 14 from oscillating as the battery voltage nears the trip point of 5.1 volts. The output from the voltage dividers 16 and 17 is applied on line 19 to the threshold detection port of the threshold circuit 14. Resistor 18 provides positive feedback from the hysteresis output to the input port. The operation of the circuit is such that the signal on line 18 reduces the sensitivity of the threshold circuit 14 to spurious noise, internal fluctuations and the like from the set point voltage provided on line 19. The application of a such threshold circuit is described in a typical application's manual by General Electric Co., Intersil Div., 1983 CMOS Databook p. 5-204 for the detector circuit 14. Circuit 14 is a commercially available integrated circuit chip of the type IGL 8211 programmable voltage reference.

Once the level of 5.1 volts or lower has been reached, the output on line 15 is supplied to an unused port or input on the on board keyboard processor 13. The processor 13 performs an internal algorithm that will be described in greater detail later and also converts the key code triggered by the input from the low battery voltage circuit 14 into a serialized signal that can be driven over the infra red transmission link previously discussed.

At the base station or control station at the other end of the infra red link 2, the receiver 3 will convert the optical signals to an electrical waveform and buffer the signals as data for use. The buffer 4 will place the serial data onto one line of the data bus and send an interrupt request to the processor 10 at the base station. The processor will perform the deserialization and convert the key codes into standard ASCII characters or the like. When the low battery code is identified, the processor 10 will direct the CRT controller 9 to display a low battery voltage warning on the display monitor 8.

Figure 3:
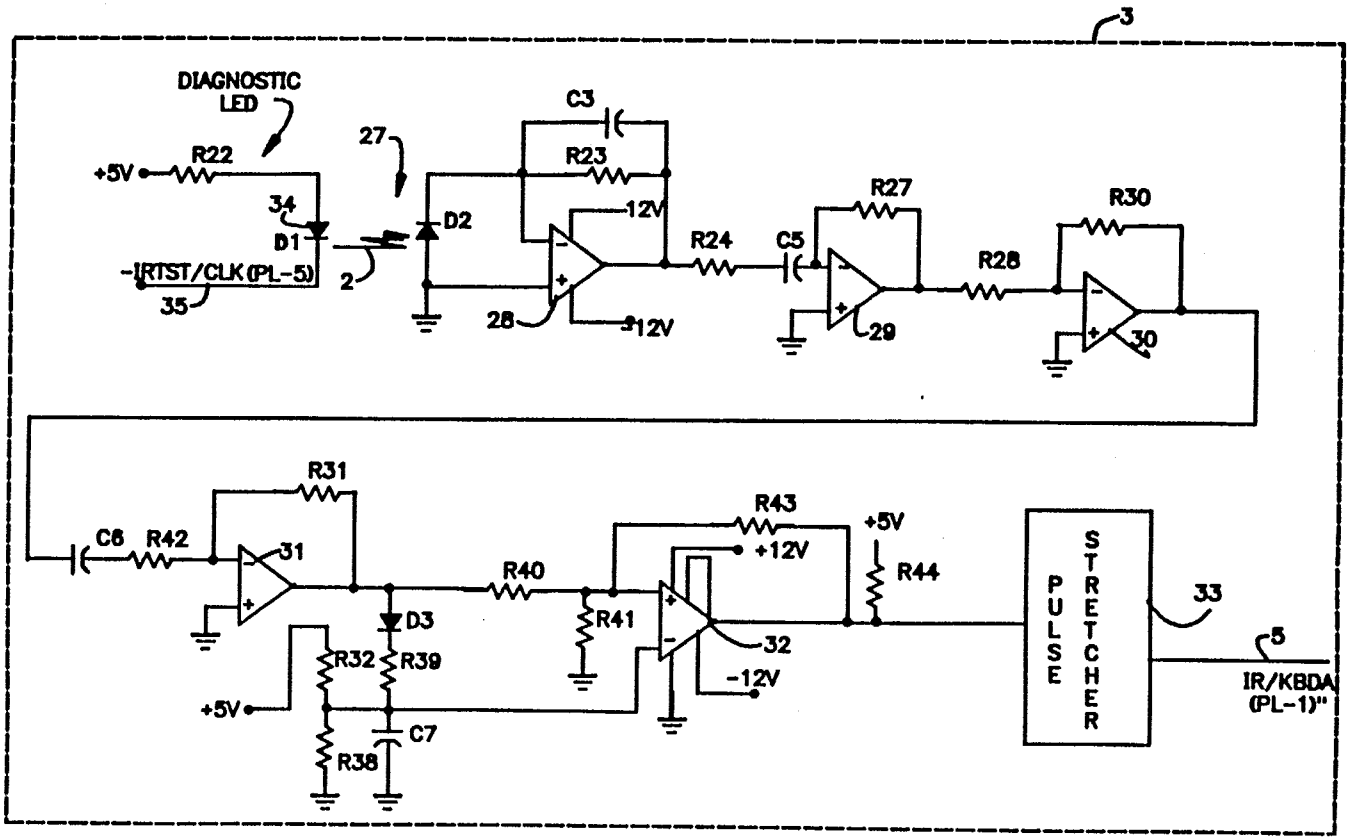
FIG. 3 illustrates a schematic for a typical base station infra red receiver circuit for inputting serially received codes to a CPU or controller at a base station.

Turning to FIG. 3, some of the details of the receiver circuit 3 are shown and described. The infra red transmission link 2 terminates at a photo sensitive diode 27 where the analog light signals are turned into electrically varying signals and amplified by the integrating amplifier 28. Transimpedance amplifier 28 converts this current signal to a voltage and performs a low pass filter functin to attenuate above band noise. Amplifier 29 provides gain and performs the high pass filter function to attenuate below band noise. Amplifiers 30 and 31 provide additional gain. The comparator 32 is an adaptive threshold circuit. The capacitor voltage on the negative input of threshold circuit 32 represents the long term average noise, which the signal must then exceed to trigger the comparator 32. The pulse stretcher 33 extends the received pulse duration to be an adequate length for the microprocessor to scan reliably on line 5. The signals are gated into the pulse stretcher 33. The output of the pulse stretcher 33 is placed on one of the data bus lines 5 to present an interrupt to the CPU 10 in FIG. 1. The CPU 10 can then receive serial data bits in this embodiment for deserialization and table look-up to determine what code has been presented.

An internal feature utilized in many commercially available infra red receivers that are microprocessor based such as the present one is in internal diagnostic control line 35 to an internally contained transmitting LED 34. This is utilized for diagnostic purposes by the CPU 10 when it wished to check out the operability of the receiver circuit beginning with the photo sensitive diode 27. It is described here only for the sake of completeness and does not form a part of the present invention.

The processor 13 in the microprocessor based keyboard 1 executes an algorithm so that the low battery warning code will not be sent to the exclusion of other codes or to the detriment of even greater battery drain. A simple counting algorithm has been designed to limit the low battery code warning to be sent only after every 16 key strokes. This assures that minimal impact of the low battery warning transmissions on overall battery drain will occur and at the same time assures that the low battery warning will only be sent during times that the keyboard is actually in use.

Figure 4:
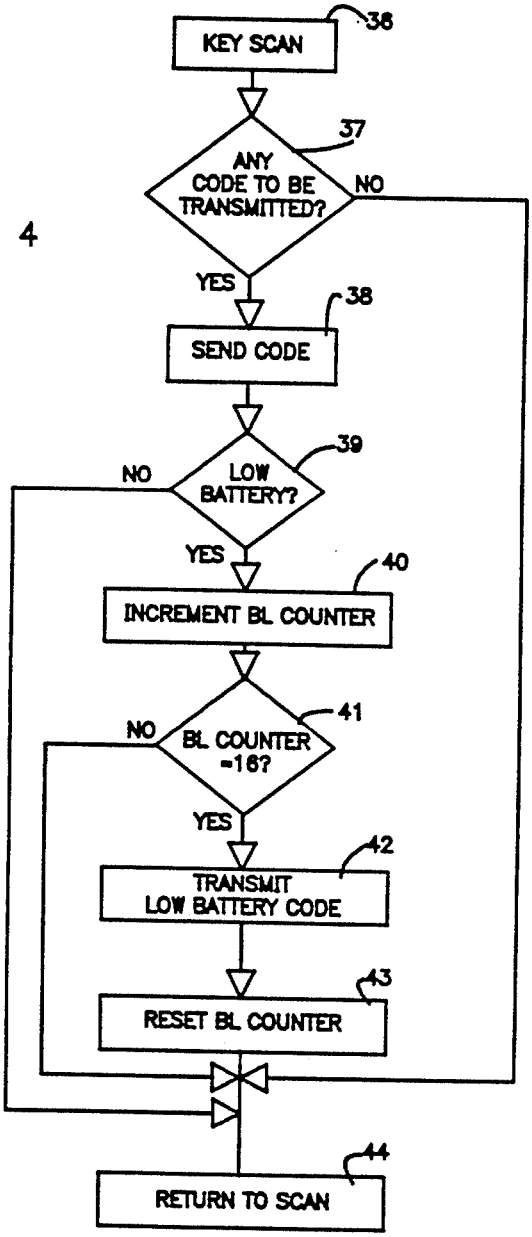
FIG. 4 illustrates a flow chart for a routine to be implemented by the keyboard or controller in on board microprocessors to avoid unnecessary sending of low battery voltage indications in error.

In the flow chart of FIG. 4, the key scan begins in block 36 and is meant to indicate that the on board processor 13 is scanning the entire key array and checking whether any key is depressed. If the code for a key is to be transmitted, block 37 illustrates that the code is to be sent as shown in block 38 and a low battery voltage check is to be made by the processor 13 to determine whether any input on line 15 is present. This is shown by block 39. If low battery voltage condition is indicated, a counter is incremented in block 40. The counter is actually an internal register in microprocessor 13 which maintains a count of indication being found present on line 15. The count is compared in block 41 against any appropriate level. A typical level of 16 has been chosen in the present example. If 16 previous low battery indications have been present for 16 times in which a key code has been transmitted, the processor will be told in block 42 to transmit the low battery indication code and to reset the low battery voltage counter in block 43. Scanning is then commenced again by block 44.

It may be seen that the logic of FIG. 4 is such that so long as active key codes are being transmitted, the microprocessor will check to see whether low battery voltage indications are also present. When such indications have been present for at least 16 transmitted key codes, it may be assumed that a true low battery voltage condition exists and that it is appropriate to transmit a low battery indication code at this time. This minimizes the impact of the low battery voltage indications on the overall battery drain and upon the interference with the user's enjoyment of usage of the system.

It will be observed that the preferred embodiment of this invention has been described with reference to a typical existing infra red linked, microprocessor based remote keyboard control environment. Similarly, other equally well known environments such as infra red remote control of TV channel selection, remote acoustic or ultrasonic control and the like may also utilize the advantages of the present invention. Thus the invention may find general applicability wherever self-contained battery driven control or keyboard devices exist. It is therefore evident that what has been described is subject to many modifications or variations of structure without departing from the basic spirit and scope of the present invention. Wherefor, what is described in the appended claims is intended to be by way of description alone and not by way of limitation.

Therefore, what is claimed and desired to be protected by Letters Patent is:

1. Low power supply voltage warning apparatus for a remote, self-contained power supply keyboard data input device, comprising:

voltage monitor means connected to the self-contained power supply voltage;

an internal reference voltage circuit driven by said power supply;

code generator means connected to said voltage monitor means for generating a low voltage indication code;

transmitter means connected to said code generator means for transmitting said low voltage indication code; and transmitter means connected to said code generator means for transmitting said low voltage indication code; and means connected to said code generator and to said transmitter for controlling issuance of said low voltage indication code to occur during times when said data input keyboard is in use for data input;

receiver means for receiving said low voltage indication code; and decoding and display means connected to said receiver means for displaying a low voltage warning when said indication code is received.

2. Apparatus as described in claim 1, further comprising:

counting means in said code generator for issuing said low voltage indication code only once in N receipts thereof from said monitor means where N is an arbitrary integer.

3. Apparatus as described in claim 1 or claim 2 wherein:

said low voltage indication code is a code within the repertoire of said generator which is not assigned to data keys or switches in said self-contained power supply data input keyboard device.

4. A method of remotely enunciating low power supply voltage from a self-powered remote keyboard data input device comprising steps of:

comparing power supply votlage output with an internal reference voltage;

signalling a low voltage indication as a result of said comparison;

transmitting on a transmission link a low voltage indication code in response to said signalling; and inhibiting transmission of said low voltage indication code during times when said keyboard is not in use for inputting data;

receiving said low voltage indication code from said transmitter and enunciating said low voltage indication at said receiver.

5. The method as described in claim 4, wherein:

said low voltage indication code is a code normally within the repertoire of said data input device not assigned to data keys or switches of said keyboard.

* * * * *